United States Patent [19]

Van Vliet, Jr.

[11] 4,105,249

[45] Aug. 8, 1978

[54] LOWER BACK STABILIZING DEVICE

[75] Inventor: Rutherford Van Vliet, Jr., Staten Island, N.Y.

[73] Assignee: The Raymond Lee Organization, Inc., New York, N.Y. ; a part interest

[21] Appl. No.: 763,704

[22] Filed: Jan. 28, 1977

[51] Int. Cl.[2] ..... A47C 7/02

[52] U.S. Cl. ..... 297/230; 5/345 R

[58] Field of Search ..... 297/284, 253, 391, 460, 297/229, 345, 230, 231; 5/345 R, 338

[56] References Cited

U.S. PATENT DOCUMENTS

| | | | |
|---|---|---|---|
| 2,551,084 | 5/1951 | Aronov | 297/229 |
| 2,557,874 | 6/1951 | Kailenta | 297/230 X |
| 2,591,306 | 4/1952 | Sherman | 297/284 |
| 2,877,833 | 3/1959 | Boles | 297/253 X |
| 3,517,963 | 6/1970 | Woods et al. | 297/229 X |
| 3,555,582 | 1/1971 | Radford | 297/230 X |
| 3,648,308 | 3/1972 | Greenswalt | 297/391 |

FOREIGN PATENT DOCUMENTS

| | | | |
|---|---|---|---|
| 13,403 of | 1929 | Australia | 297/253 |
| 1,544,119 | 9/1968 | France | 5/338 |

*Primary Examiner*—James T. McCall
*Attorney, Agent, or Firm*—Daniel Jay Tick

[57] ABSTRACT

An aluminum strap is passed through a slot formed through a wedge shaped cushion and extends along the sides of the cushion. A pair of handles are affixed to the ends of the aluminum strap at the juncture of the sides of the cushion with the top thereof. A cloth strap extends between the handles of the aluminum strap along the surface of the top of the cushion. An anchor rope anchors the aluminum strap in the area of the junction of the bottom and back of the cushion to a point behind the seat.

5 Claims, 4 Drawing Figures

LOWER BACK STABILIZING DEVICE

BACKGROUND OF THE INVENTION

The present invention relates to a lower back stabilizing or supporting device. More particularly, the invention relates to a lower back cushioning and stabilizing device for a person seated on a seat having a back rest.

Objects of the invention are to provide a lower back stabilizing device of simple structure, which is inexpensive in manufacture, used with facility and convenience, adjustable to a desired position, and functions efficiently, effectively and reliably to improve the posture of a seated person, and especially the operator of a motor vehicle, by maintaining the operator's lower back tightly against the back rest of the seat thereby minimizing pinching and irritation of nerves of the area of the lower spine.

The stabilizing device of the invention functions to lessen movement of the backbone of the user, so that there is less irritation of nerves.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
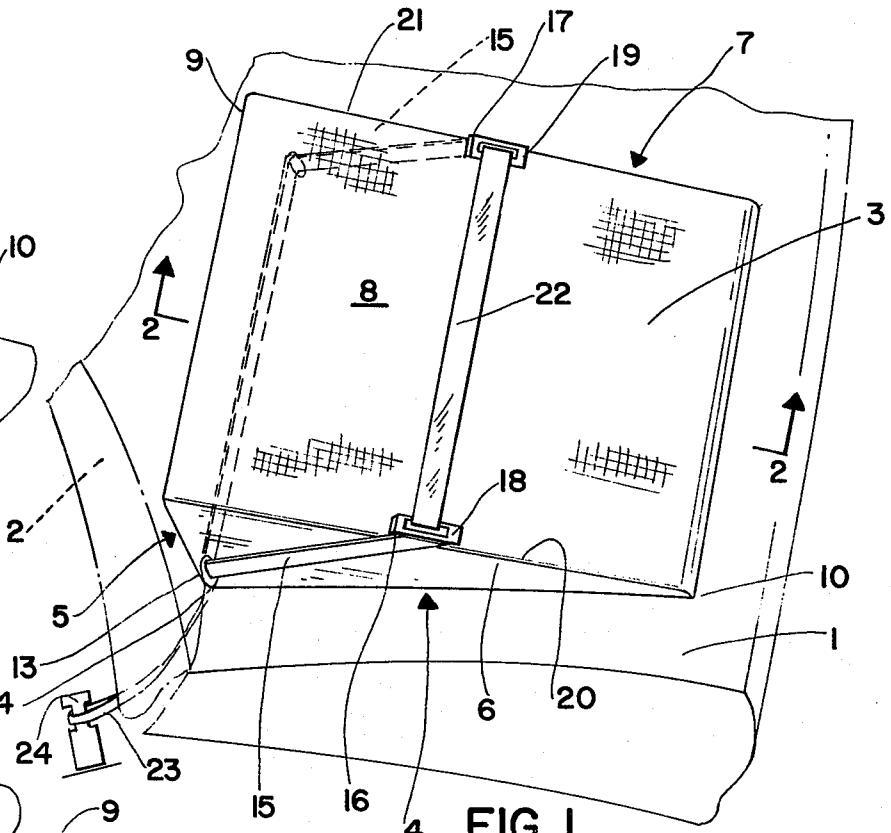
FIG. 1 is a perspective view, from the top and one side, of an embodiment of the lower back stabilizing device of the invention.
Figure 3:
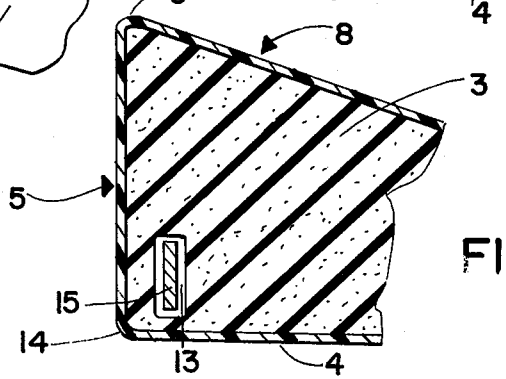
FIG. 3 is a view, on an enlarged scale, of part of FIG. 2.
Figure 2:
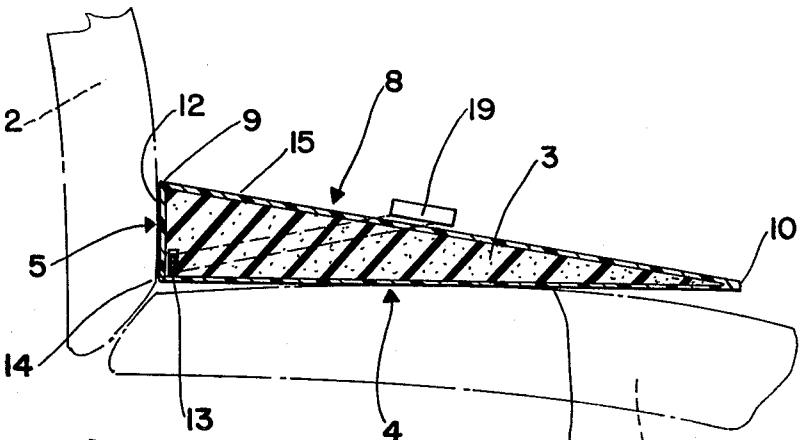
FIG. 2 is a cross-sectional view, taken along the lines II—II, of FIG. 1.
Figure 4:
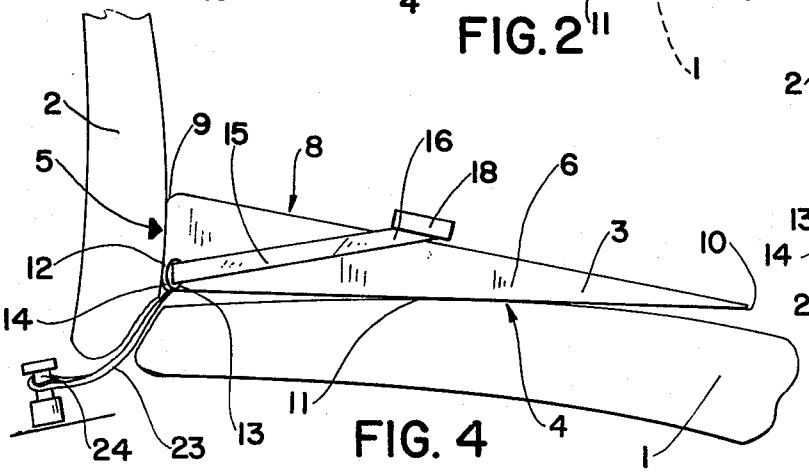
FIG. 4 is a side view of the embodiment of FIG. 1.

The lower back stabilizing device of the invention is for a person (not shown in the FIGS.) seated on a seat 1 (FIGS. 1, 2 and 4) having a back rest 2 (FIGS. 1, 2 and 4).

The lower back stabilizing device of the invention comprises a wedge shaped cushion 3 having a substantially planar substantially rectangular bottom 4 and a substantially planar substantially rectangular back 5 meeting the bottom 4 at substantially right angles (FIGS. 1 to 4). The cushion 3 also has a pair of right triangular substantially planar sides 6 and 7 (FIG. 1), a substantially rectangular top 8 sloping downward from the top edge 9 of the back 5 to the leading edge 10 of the bottom 4, as shown in FIGS. 1, 2 and 4.

The cushion 3 has a triangular cross-section with a first arm 11 of the bottom of predetermined length substantially abutting the seat 1 and a second arm 12 of the back 5 extending at right angles to the first arm 11, and a fraction of the length of the first arm, substantially abutting the back rest 2, as shown in FIGS. 2 and 4. The cushion has a slot 13 formed therethrough substantially parallel to the back 5 in the area of the juncture 14 of the bottom 4 and the back, as shown in FIGS. 1 to 4.

An aluminum strap 15 passes through the slot 13 and extends along the sides 6 and 7 of the cushion. The aluminum strap 15 has ends 16 and 17, respectively (FIG. 1) at the top 8 of the cushion.

A pair of handles 18 and 19 are affixed to the ends 16 and 17, respectively, of the aluminum strap 15 at the junctures 20 and 21, respectively, of the sides 6 and 7 of the cushion with the top 8, as shown in FIG. 1.

A cloth strap 22 (FIG. 1) extends between the handles 18 and 19 of the aluminum strap 15 along the surface of the top 8 of the cushion 3.

An anchor rope 23 (FIGS. 1 and 4) anchors the aluminum strap 15 in the area of the junction 14 of the bottom 4 and the back 5 of the cushion to a point 24 behind the seat 1. The point 24 is provided in the configuration of a peg type member heavier at one end than at the other, as shown in FIGS. 1 and 4. The peg type member 24 may thus hang in back of the seat or may be affixed to the floor of the vehicle. The member 24 remains behind the seat and cannot be pulled between the seat 1 and the back rest 2 without being positioned non-vertically. Its heavier end maintains it in vertical position, however. This eliminates the need for affixing the member 24 to the floor, thereby making the installation of the device of the invention more economical and permitting the user to install it himself.

In adjusting the lower back supporting device of the invention, the driver first places the cushion on the seat of the vehicle and pushes the anchor rope through the space between the seat and the back rest. He or she then ties the anchor rope to the anchor peg with a suitable knot. The driver then sits on the cushion and pushes down on the handles of the aluminum strap. At the same time, the driver elevates himself or herself off the cushion. The rear part of the top of the cushion then moves forward. The driver lets himself or herself down on the cushion, and the rear part of the top of the cushion pulls the driver snugly back against the back rest, when the handles are let up providing the best possible stabilization for the lower back and relieving irritation or excess distortion.

While the invention has been described by means of a specific example and in a specific embodiment, I do not wish to be limited thereto, for obvious modifications will occur to those skilled in the art without departing from the spirit and scope of the invention.

I claim:

1. A lower back stabilizing device for a person seated on an independent cushion on a seat having a back rest, said back stabilizing device comprising anchor means for securing the cushion to the seat, said anchor means including a substantially square U-shaped strap of substantially rigid material coupled to the cushion in one are thereof, said strap having a pair of spaced opposite ends, and a strap of substantially flexible material affixed to and extending between the ends of the substantially rigid strap in a spaced opposite area of said cushion.

2. A lower back stabilizing device as claimed in claim 1, wherein said substantially rigid strap consists of metal and said substantially flexible strap consists of cloth.

3. A lower back stabilizing device as claimed in claim 1, wherein said substantially rigid strap consists of aluminum.

4. A lower back stabilizing device as claimed in claim 1, wherein the cushion is of wedge shape having a substantially planar substantially rectangular bottom substantially abutting the seat, a substantially planar substantially rectangular back meeting the bottom at substantially right angles and substantially abutting the back rest, a pair of right triangular substantially planar sides, a substantially planar substantially rectangular top sloping downward from the top edge of the back to the leading edge of the bottom, and a right triangular cross-section with a first arm of the bottom of predetermined length substantially abutting the seat and a second arm of the back extending at right angles to the first arm and a fraction of the length of the first arm substantially abutting the back rest, said cushion having a slot formed therethrough substantially parallel to the back in the area of the juncture of the bottom and back, and wherein said substantially rigid strap passes through the slot and extends along the sides of the cushion, the ends of said substantially rigid strap being at the top of the cushion.

5. A lower back stabilizing device as claimed in claim 1, wherein the ends of the aluminum strap are at the top of the cushion, and further comprising a pair of handles affixed to the ends of the aluminum strap at the juncture of the sides of the cushion with the top, said substantially flexible strap extending between the handles of the aluminum strap along the surface of the top of the cushion.

* * * * *